US006986176B1

(12) United States Patent
Lin

(10) Patent No.: US 6,986,176 B1
(45) Date of Patent: Jan. 17, 2006

(54) CONVERTIBLE HEADBOARD

(76) Inventor: Terry Kang Lin, 193 Trestle Cove, Hercules, CA (US) 94547

( * ) Notice: Subject to any disclaimer, the term of this patent is extended or adjusted under 35 U.S.C. 154(b) by 0 days.

(21) Appl. No.: 10/899,428

(22) Filed: Jul. 26, 2004

(51) Int. Cl.
*A47C 20/04* (2006.01)

(52) U.S. Cl. ..... 5/53.1; 5/503.1

(58) Field of Classification Search ..... 5/53.1–53.3, 5/503.1, 54; 108/11, 17, 42
See application file for complete search history.

(56) References Cited

U.S. PATENT DOCUMENTS 3,351,960 A * 11/1967 Burkholder ..... 5/635

5,425,148 A * 6/1995 Ashcraft et al. ..... 5/507.1

* cited by examiner

*Primary Examiner*—Heather Shackelford
*Assistant Examiner*—Fredrick Conley
(74) *Attorney, Agent, or Firm*—Michael E. Dergosits; Dergosits & Noah LLP

(57) ABSTRACT

A combination headboard and stowable tray characterized as having a vertically extending front surface and vertically extending back surface being spaced apart from one another to create a tray stowing compartment. A tray is pivotally appended to the bed headboard oriented substantially in a vertical orientation when stowed within the headboard and between the vertically extending front and back surfaces. The tray is rotatable about a first pivot to extend the tray outwardly from between the vertically extending front and back members while maintaining its vertical orientation. A second is pivot is provided for rotating the tray to a substantially horizontal orientation for its deployment as a tabletop.

10 Claims, 2 Drawing Sheets

CONVERTIBLE HEADBOARD

TECHNICAL FIELD

The present invention involves a combination headboard and stowable tray. A tray stowing compartment is created between front and back surfaces of the headboard to provide a space for stowing the tray to provide a headboard of conventional appearance. However, the stowable tray is pivotally removable from the headboard providing a convenient and functional tabletop capable of providing a level of convenience and functionality heretofore unattainable.

BACKGROUND OF THE INVENTION

It is quite common to employ trays and tables adjacent to beds for a multitude of purposes. Many people find it relaxing the have breakfast or some other meal in bed where a tray is placed on or in conjunction with a user. However, as one or more persons shift their weight in bed, trays residing upon a mattress surface or on the lap of a user can often times shift resulting in liquids and other consumables spilling from the tray and onto a user or the surrounding bedding surface.

Trays and portable tables are also used in hospitals and similar environments where a bedridden patient is forced to consume his or her meals in a prone or semi-prone orientation. Generally, portable tabletops are wheeled adjacent the bed to provide a substantially horizontally-oriented tabletop surface. However, portable trays of this type are generally supported by vertically extending support members and are usually attached to a wheeled base which limits access to the patient. Further, as a nurse or other healthcare practitioner works with the patient in proximity to the portable tray, the structure can be nudged or bumped inadvertently causing the contents residing on the tray surface to spill.

It is quite apparent that there are a wide variety of uses for horizontally-oriented trays in conjunction with bedding. However, the prior art has seemingly completely ignored the above-recited limitations.

It is thus an object of the present invention to provide a combination headboard and stowable tray while avoiding the limitations of the prior art.

It is yet a further object of the present invention to provide a combination headboard and stowable tray which can function to provide a horizontally-oriented tabletop surface on demand but which, when not in use, can appear as a decorative headboard similar to those of the prior art.

These and further objects will become more readily apparent when considering the following disclosure and appended claims.

SUMMARY OF THE INVENTION

The present invention is directed to a combination headboard and stowable tray comprising a bed headboard having a vertically extending front member and vertically extending back member. The vertically extending front and back members are spaced apart from one another to create a tray stowing compartment. A tray is provided being pivotally appended to the bed headboard and oriented substantially in a vertical orientation when stowed within the headboard and between the vertically extending front and back members. The tray is rotatable about a first pivot to extend the tray outwardly from between the vertically extending front and back members while maintaining its vertical orientation. A second pivot is provided for rotating the tray to a substantially horizontal orientation for its deployment as a tabletop.

DETAILED DESCRIPTION OF THE INVENTION

Figure 1:
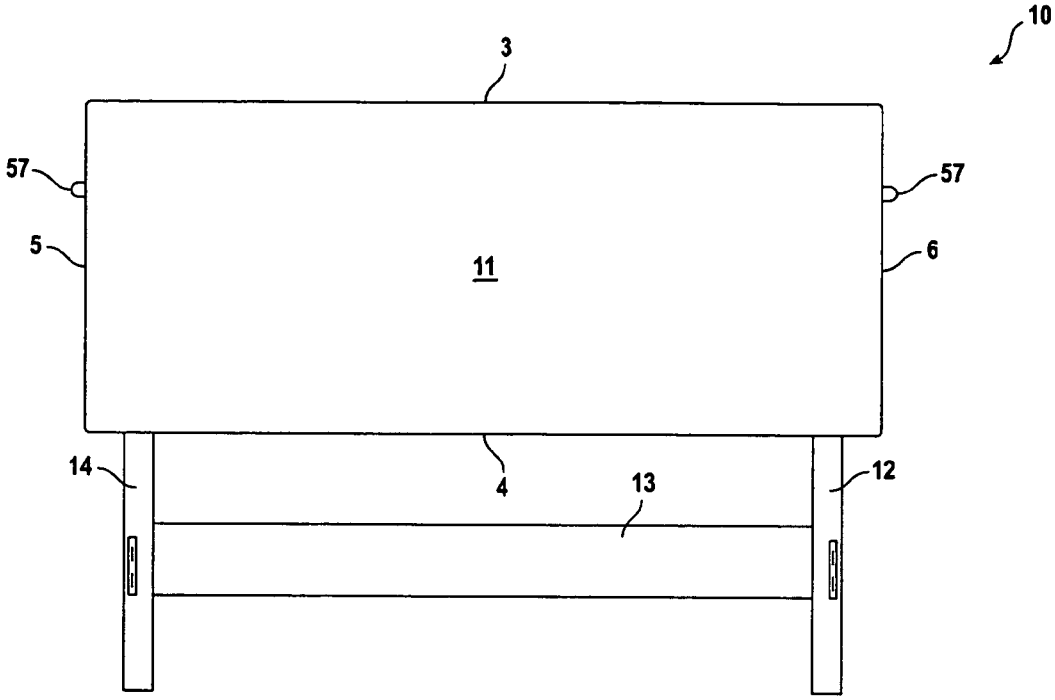
FIG. 1 is a side plan view of the headboard of the present invention as it would visually appear to a user.

Turning first to FIG. 1, headboard 10 is depicted wherein stowable tray 20 (FIGS. 2 and 3) is stowed. Headboard 10 is generally rectangular having top and bottom edges 3 and 4 and side edges 5 and 6. The headboard is supported by legs 12 and 14 with cross brace member 13. Obviously, bedding to be used in conjunction with headboard 10 is not depicted.

Figure 3:
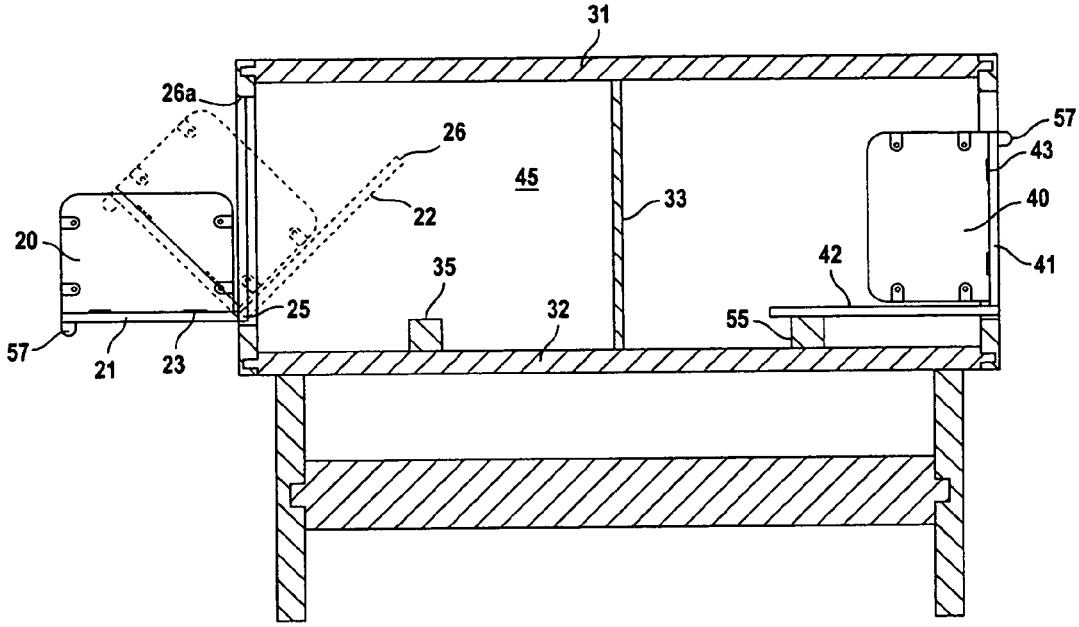
FIG. 3 is a cross sectional plan view of the headboard of FIG. 2 taken along cross sectional line 3—3.

Headboard 10 is provided with a vertically extending front surface 11 and vertically extending back surface 9 being spaced apart from one another to create tray stowing compartment 45 (FIG. 3). Tray 20 is pivotally appended to headboard 10 and is oriented substantially in a vertically orientation when stowed within tray stowing compartment 45 and between vertically extending front and back surfaces 9 and 11.

Figure 2:
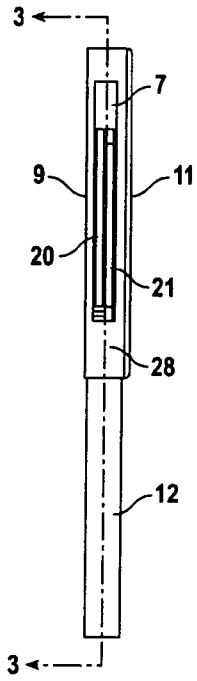
FIG. 2 is a side plan view of the headboard of FIG. 1.

As best visualized by reference to FIG. 2, tray 20 is rotatable about first pivot 25 to extend tray 20 outwardly from tray stowing compartment 45 while maintaining its vertical orientation. Second pivot 23 is provided for rotating tray 20 to a substantially horizontal orientation for its deployment as a tabletop.

To provide an aesthetically pleasing presentation, headboard 10 can be padded or finished in a variety of veneers suitable for virtually any décor. Preferably, the finished appearance of headboard 10 can be enhanced by providing bridging slats 28, the width of which define the width of tray stowing compartment 45. Functionally, slats 28 are provided with opening 7 of sufficient size to enable a user's finger to enter tray stowing compartment 45 and to pivotally rotate tray 20 from tray stowing compartment 45 about first pivot 25. Alternatively, tray 20 can be pulled from compartment 45 by grasping pull tabs 57 (FIG. 3). As noted by reference to FIG. 3, a second tray 40 can likewise be provided deplorable from tray stowing compartment 45 and pivotally extendable from side edge 6. An opening similar to opening 7 (FIG. 2) on pull tab 57 would obviously be provided to enable one to access tray 40 and remove it from tray stowing compartment 45 as needed.

As a preferred embodiment, tray 20 is appended to a tray support comprising first and second orthogonally extending tray supporting members 21 and 22, respectively. It is noted by referring to tray 40 that when the tray is in its substantially vertically stowed position, first tray supporting member 41 resides within opening 7 (FIG. 2) between front and back surfaces 9 and 11 at bridging slat 28. This orientation is maintained through the use of stop members 35 and 55 which limit pivotal rotation of first and second orthogonally extending tray support members 21/22 and 41/42 as trays 20 and 40 are stowed within tray stowing compartment 45. Note that in doing so, as the respective trays are stowed, tray support members 21 and 41 assume a substantially vertical orientation while tray support members 22 and 42, residing upon stop members 35 and 55, respectively, assume a substantially horizontal orientation.

As noted, stop members 35 and 42 are appended to and are supported by horizontally extending frame member 32.

Turning again to FIG. 3, internally maintained structural support members 31, 32 and 33 act to create tray storing compartment 45 by defining the spacing between vertically extending front and back surfaces 9 and 11. It is noted that as tray 20 rotates about first pivot 25, second tray supporting member 22 moves counter clockwise. Second tray support member 22 (as well as second tray supporting member 42) is sized with regard to opening 7 as to limit pivotal rotation of first and second orthogonally extending tray support members 21 and 22 as the tray is pivotally rotated out of the tray storing compartment. Ideally, second tray supporting member 22 is sized to substantially completely fill opening 7 between front and back members 9 and 11 as tray 20 is completely pivoted out of tray storing compartment 45. As an alternative expedient, extender 26 can be fastened to second tray supporting member 22 acting as a rotational stop as it abuts stop plate 26*a*. In doing so, second tray support member 22 substantially completely fills opening 7 to create a finished and aesthetically pleasing visual appearance as opening 7 within headboard 10 is filled upon tray deployment.

Once trays 20 and 40 are rotated from tray stowing compartment 45, they are rotated through second pivots 23 and 43, respectively. Ideally, the second pivots are hinges enabling trays 20 and 40 to rotate from their stowed vertical to functional horizontal orientations with respect to first orthogonally tray supporting members 21 and 41, respectively.

As noted from the above discussion, what has been provided is a traditionally appearing headboard which can function with regard to traditional bedding but which also can provide enhanced functionality by presenting to a user one or more horizontally extending trays. As such, such headboard can be employed over a wide variety of applications.

What is claimed is:

1. A combination headboard and stowable tray comprising a bed headboard having a vertically extending front surface and vertically extending back surface said vertically extending front and back surfaces being spaced apart from one another to create a tray stowing compartment, a tray pivotally appended to said bed headboard, said tray being oriented substantially in a vertical orientation when stowed within said headboard and between said vertically extending front and back surfaces, said tray being rotatable about a first pivot to extend said tray outwardly from between said vertically extending front and back surfaces while maintaining its vertically orientation and a second pivot for rotating said tray to a substantially horizontal orientation for its deployment as a table top.

2. The combination headboard and stowable tray of claim 1 wherein said vertically extending front and back surfaces are substantially rectangular having substantially parallel top and bottom and substantially parallel side edges, and wherein at least said top and side edges being appended to bridging slats, the width of which defines said tray stowing compartment.

3. The combination headboard and stowable tray of claim 2 wherein at least one of said side edges is provided with an opening of sufficient size to enable a user to access said tray stowing compartment and to pivotally rotate said tray from said tray stowing compartment about said first pivot.

4. The combination headboard and stowable tray of claim 2 wherein said tray further includes a pull tab for gripping by a user to pivotably rotate said tray from said tray stowing compartment.

5. The combination headboard and stowable tray of claim 2 wherein two trays are deployable from said tray stowing compartment, each being pivotally extendable from said parallel side edges.

6. A combination headboard and stowable tray comprising a bed headboard having a vertically extending front surface and vertically extending back surface, each being maintained in a substantially parallel spaced apart relationship by internally maintained structural support members to create a tray storing compartment, a tray support comprising first and second orthogonally extending tray supporting members sized and oriented such that when said tray is in its substantially vertically stowed position, said first tray supporting member resides within an opening between said front and back surfaces proximate one of the vertical edges of said front and back surfaces and said second tray supporting member being fully contained in said tray stowing compartment in a substantially horizontal orientation, said first and second tray supporting members being pivotable to extend said tray outwardly from said tray stowing compartment while being maintained in said vertical orientation and said tray being pivotable about said first tray supporting member to assume a substantially horizontal orientation for its deployment as a tabletop.

7. The combination headboard and stowable tray of claim 6 wherein at least one of said structural support members is provided with a stop member to limit pivotal rotation of said first or second orthogonally extending tray support members as said tray is stowed within said tray storing compartment.

8. The combination headboard and stowable tray of claim 6 wherein said second tray supporting member is sized with regard to said opening between said front and back members to limit pivotal rotation of said first and second orthogonally extending tray support members as the tray is pivotally rotated out of said tray storing compartment.

9. The combination headboard and stowable tray of claim 8 wherein said second tray supporting member is sized to substantially completely fill the opening between said front and back surfaces as said tray is completely pivoted out of said tray storing compartment.

10. The combination headboard and stowable tray of claim 6 wherein said tray is pivotably about said first tray supporting member through the use of at least two hinges appended to an edge of said tray and said first tray supporting member.

* * * * *